US007246470B2

(12) United States Patent
Beyrle

(10) Patent No.: US 7,246,470 B2
(45) Date of Patent: Jul. 24, 2007

(54) INSULATING GLASS ELEMENT, ESPECIALLY FOR A REFRIGERATED ENCLOSURE

(75) Inventor: Andre Beyrle, Tracy le Val (FR)

(73) Assignee: Saint-Gobain Glass France, Courbevoie (FR)

( * ) Notice: Subject to any disclaimer, the term of this patent is extended or adjusted under 35 U.S.C. 154(b) by 714 days.

(21) Appl. No.: 10/469,133

(22) PCT Filed: Feb. 27, 2002

(86) PCT No.: PCT/FR02/00708

§ 371 (c)(1),
(2), (4) Date: Aug. 27, 2003

(87) PCT Pub. No.: WO02/069673

PCT Pub. Date: Sep. 6, 2002

(65) Prior Publication Data

US 2004/0080122 A1 Apr. 29, 2004

(30) Foreign Application Priority Data

Feb. 28, 2001 (FR) ..... 01 02708

(51) Int. Cl.

| | |
|---|---|
| ***E06B 7/00*** | (2006.01) |
| ***H05B 1/00*** | (2006.01) |
| ***H05B 3/00*** | (2006.01) |
| ***H05B 11/00*** | (2006.01) |
| ***H05B 3/06*** | (2006.01) |

(52) U.S. Cl. ..... 52/171.1; 219/213; 219/522

(58) Field of Classification Search ..... 52/171.1, 52/171.2, 172, 202, 203, 205, 204.5, 204.593, 52/204.595, 204.68, 204.71, 786.1, 786.13, 52/788.1; 219/203, 213, 406, 407, 522; 62/275
See application file for complete search history.

(56) References Cited

U.S. PATENT DOCUMENTS

| | | | | | |
|---|---|---|---|---|---|
| 1,856,008 | A | * | 4/1932 | Warren | 52/172 |
| 2,030,117 | A | * | 2/1936 | Page | 219/203 |
| 3,655,939 | A | | 4/1972 | Stromquist | |
| 4,127,765 | A | * | 11/1978 | Heaney | 219/218 |
| 4,213,028 | A | * | 7/1980 | Wolf | 219/203 |
| 4,459,470 | A | * | 7/1984 | Shlichta et al. | 219/522 |
| 4,477,129 | A | * | 10/1984 | Heaney | 312/116 |
| 4,613,530 | A | * | 9/1986 | Hood et al. | 428/34 |
| 4,658,553 | A | * | 4/1987 | Shinagawa | 52/172 |
| 5,059,458 | A | * | 10/1991 | Goodall | 428/34 |
| 5,120,584 | A | * | 6/1992 | Ohlenforst et al. | 428/34 |
| 5,269,108 | A | * | 12/1993 | Fremaux | 52/302.1 |
| RE35,149 | E | * | 1/1996 | Richardson et al. | 52/204.593 |
| RE35,392 | E | * | 12/1996 | Richardson et al. | 52/172 |
| 6,144,017 | A | * | 11/2000 | Millett et al. | 219/522 |
| 6,268,594 | B1 | * | 7/2001 | Leutner et al. | 219/522 |
| 2003/0019859 | A1 | * | 1/2003 | Sol | 219/203 |
| 2005/0126091 | A1 | * | 6/2005 | Sherrett et al. | 52/204.6 |
| 2006/0059861 | A1 | * | 3/2006 | Grassmuck et al. | 52/786.1 |

FOREIGN PATENT DOCUMENTS

| | | |
|---|---|---|
| CA | 885052 | 11/1971 |
| EP | 0 314 477 | 5/1989 |
| FR | 2 769 337 | 4/1999 |

* cited by examiner

*Primary Examiner*—Carl D. Friedman
*Assistant Examiner*—Ryan Kwiecinski
(74) *Attorney, Agent, or Firm*—Oblon, Spivak, McClelland, Maier & Neustadt, P.C.

(57) ABSTRACT

An insulating glazed element including at least two glass sheets, separated from each other by a space and joined at their periphery by a seal, and at least one section. The glazed element has at least one heating border on at least one face of at least one glass sheet, and the border is covered by the section and joined to the section by a heat-conducting seal.

10 Claims, 4 Drawing Sheets

INSULATING GLASS ELEMENT, ESPECIALLY FOR A REFRIGERATED ENCLOSURE

BACKGROUND OF THE INVENTION

1. Field of the Invention
2. Discussion of the Background

The invention relates to an insulating glazed element comprising at least two glass sheets separated from each other by a space and at least one support element, especially for a refrigerated enclosure.

Glazing panels are generally placed in a frame making it possible to support them for the purpose of their use in fields where their thermal insulation properties are sought (building, refrigeration, etc.).

It is well known that when a cold wall is in contact with hot and moist air, the wall becomes covered with water from the condensation of the ambient water vapor, it being possible for this water even to become transformed into frost if the temperature is low enough. More specifically, it is when the temperature of the wall is less than the dew point of the ambient air that condensation is produced. In the case of glazing panels, the condensation may appear on the glass and also on the frame which supports the glazing panel, particularly if it is metallic and therefore capable of forming a thermal bridge.

The main feature of the means which have been proposed to overcome the drawbacks associated with the appearance of condensation and with the formation of frost relates to limiting heat exchanges between the walls of the glazing panel. It has thus been proposed to use insulating glazing panels, formed by the superposition of glass sheets separated from each other by a layer of air or by a space kept under vacuum, and to heat them over the entire surface of the glass by means of an electrically conductive layer (EP-A-0 314 477, U.S. Pat. No. 3,655,939 and FR-A-2 769 337) or of metal wires supplied with electric current (CA-A-885052).

The problem of condensation and of frost mentioned above appears more specifically in the field of refrigeration at relatively low temperature used especially for the preservation of frozen food items.

It is usual for frozen food items to be offered for sale by displaying them in freezers which are open at the top (or chest freezers), the front face and/or at least one side face of which is(are) glazed. This method of displaying the food items has two advantages:

the first advantage is that it is possible, even at a distance, to quickly select the type of food sought because of the transparency of the front face, and the second advantage is that it is easy to grab hold of the article which is finally chosen since the freezer is permanently open in its upper part.

With chest freezers, and in spite of the use of insulated glazing, there is still the problem of condensation or of frost at the periphery of the glazed surface. Because of their exposure to cold, the outside of the perimeter of the glazing, which is less insulated than the rest of the glazed surface, and of the elements supporting the glazing are at a lower temperature than that of the ambient air, which generates condensation both on the glass and on the support.

The presence of condensation water or of frost has drawbacks: reduction in the field of vision through the glazed element, appearance of mold, formation of puddles on the ground, transfer of moisture to the skin, the presence of stains on the clothing, the risk of the skin "sticking" to the frosted parts, etc.

To overcome these drawbacks, it is known to heat the glazed element by means of a peripheral metal bead concealed in the frame supporting the glazed wall. However, this bead is not entirely satisfactory:

it is minimally adjustable because its length depends entirely on the dimension of the glazing, it is tricky and expensive to implement because it is necessary to make a perfectly gaged groove in the thickness of the seal of the glass sheets, since the contact area between the bead and the frame is small, the heating efficiency is low, and given that it is fed by an electric current of high voltage (about 220 volts), a safety device, which breaks the circuit in the case of accidental breakage of the glass, must absolutely be combined therewith.

SUMMARY OF THE INVENTION

The aim of the present invention is to produce an insulating glazed element formed from at least two glass sheets and at least one section, which makes it possible to prevent the appearance of condensation and the formation of frost on the periphery.

The invention proposes an insulating glazed element comprising at least two glass sheets and at least one section, said element having at least one heating border on at least one face of at least one glass sheet, and the border being covered by the section and being joined to the section by means of a heat-conducting seal. In this way, by heating the edge of the glazing, it is possible to keep the glass and the section at a temperature greater than the dew point of the ambient air, and therefore to prevent the formation of condensation and of frost on the glass.

In the context of the invention, when the glazed element comprises several sheets of glass:

"outer glass sheet" denotes the glass sheet which is in contact with the ambient air when the sheet is in its position of use, "inner glass sheet" denotes the sheet of glass which is in contact with the cold air produced by the refrigerated enclosure, and "intermediate sheet" denotes a sheet which is between the outer sheet and the inner sheet, "external face" denotes the face of a glass sheet which is oriented toward the ambient air, and "internal face" denotes the face of a glass sheet which is oriented toward the cold air.

According to a preferred embodiment, the heating border is borne by the external face of the outer glass sheet. In this way, the border is directly in contact, over its entire surface, with the heat-conducting seal, which makes it possible to heat the section with maximum efficiency.

Advantageously, the heating border is formed by the deposition of enamel or of resin containing electrically conductive particles, such as particles of silver, nickel, zinc, copper, graphite or of a precious metal such as gold, platinum or palladium. Silver particles are preferred, in particular because they have an advantageous conductivity/cost ratio.

The enamel used in the invention may be any composition comprising a glass frit, possibly combined with pigments (as coloring agents, these pigments possibly forming part of the frit), and a medium. The glass frit may be any glass frit making it possible to finally form a vitreous matrix on the support, preferably a matrix which can withstand the temperatures required for the thermal toughening (maximum temperature of about 650° C.). Mainly for considerations of recycling, a frit which contains virtually no lead is preferred.

The medium ensures the solid particles are suspended correctly and allows application and temporary adhesion of enamel to the glass. The medium is generally chosen from organics such as pine oil, terpenes, mineral oils, diluents and resins. The resin used in the invention is chosen from resins capable of finally forming a polymer layer on the glass support. Preferably, the resin is an epoxy resin, polyimide, silicone, polyester or polyacrylate.

In general, the heating border is obtained by depositing the enamel or polymer resin composition containing the metal particles onto the glass by sputtering, by roller or curtain coating, or by screen printing, and by subjecting the glass thus coated to curing at a temperature of about 500 to 650° C. for enamel and 100 to 200° C. for a resin. Preferably, screen printing is used.

The border may extend over the entire length of one side of the glass sheet(s) in question, or occupy only part of the length. The ends of the border are provided with current-supply elements, for example welded or bonded terminals, making it possible to heat the border over its entire length. Depending on the use envisioned, the border may be placed on a single side or on several sides. Preferably, the border is borne by at least two sides, advantageously opposite sides, and better still, by three or four sides. In the latter case, the border is advantageously continuous and connected at its two ends to the electric current.

The length, the width, the thickness and the shape of the border are not critical. In this respect, the invention makes it possible to alter and to optimize the intensity of heating of the border easily: in particular, by varying the width, it is possible to easily obtain parts which are more heated than others within the same strip or several strips. However, it is preferable to choose a shape and a size such that the border may be hidden by the section supporting the glass sheets. Apart from the undeniable esthetic appearance, when the border is borne by the external face of the outer sheet, the covering by the section makes it possible to protect it from subsequent damage such as, for example, that resulting from the application of certain cleaning products.

The heat-conducting seal generally consists of a polymer comprising conductive particles, for example a silicone or an epoxy resin in combination with alumina particles.

According to a second embodiment, the heating border is borne by the internal face of the outer glass sheet.

According to a third embodiment, the heating border is located on the external face of an intermediate glass sheet or of an inner glass sheet.

In accordance with the second and third embodiments, it is advantageous to combine an intermediate element which can conduct heat with the heating border. This intermediate element may, for example, be a metal sheet, at least one of the ends of which is folded in order to form an angle which is substantially a right angle or a metal L-section or T-section, and one of the ends being connected to the border, for example by welding or bonding, and the other or another free end being placed parallel to the thickness of the glass sheet bearing the border. This method provides a greater area of contact between the border and the heat-conducting seal, which consequently makes it possible to increase the heating efficiency of the section supporting the glass sheets.

In a preferred manner, and independently of the embodiment, the glazed element comprises at least two glass sheets separated from each other by a space and joined at their periphery by a seal, advantageously a watertight seal. In a particularly preferred manner, the element consists of three glass sheets.

According to a variant of the invention, the outer sheet is a glass sheet having undergone thermal toughening. Thermal toughening makes it possible to generate considerable stresses in the glass such that, when it is broken accidentally, it shatters into fragments which are small enough not to cause injury. The toughening stage is an operation known per se: by way of illustration, it is possible, for example, to carry out the toughening at a temperature of about 550 to 650° C. for 2 to 4 minutes depending on the thickness of the glass. When this sheet bears one or more heating borders in the form of an enamel coating, toughening also makes it possible to cure the enamel.

BRIEF DESCRIPTION OF THE DRAWINGS

Other advantageous details and features of the invention will be appear on reading the examples of devices illustrated by the following figures.

DESCRIPTION OF THE PREFERRED EMBODIMENTS

Figure 1:
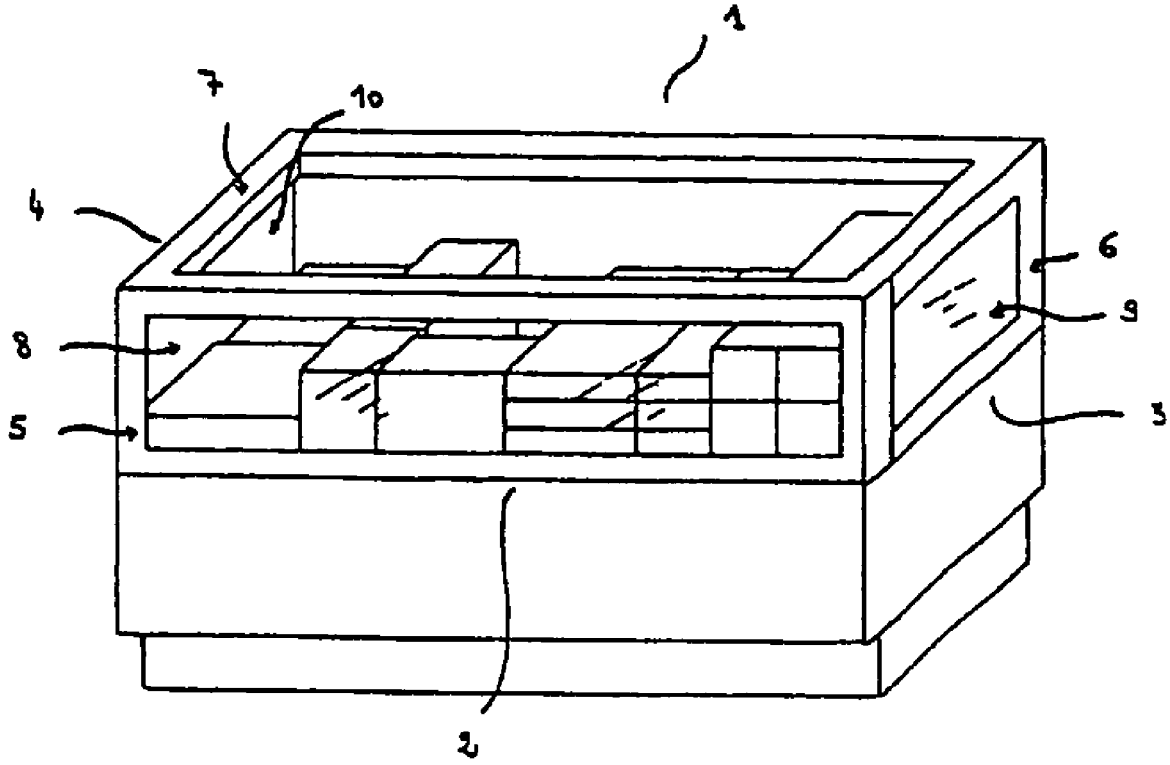
FIG. 1 is a schematic representation of a chest freezer using the glazed element according to the invention.

FIG. 1 shows a refrigerated enclosure 1 of the chest freezer type, open at the top, the front and side faces of which are equipped with insulating glazed elements 2, 3, 4 according to the invention. In this case, each glazed element 2, 3, 4 consists of one or more sections forming a frame 5, 6, 7 supporting glass sheets 8, 9, 10.

Figure 2:
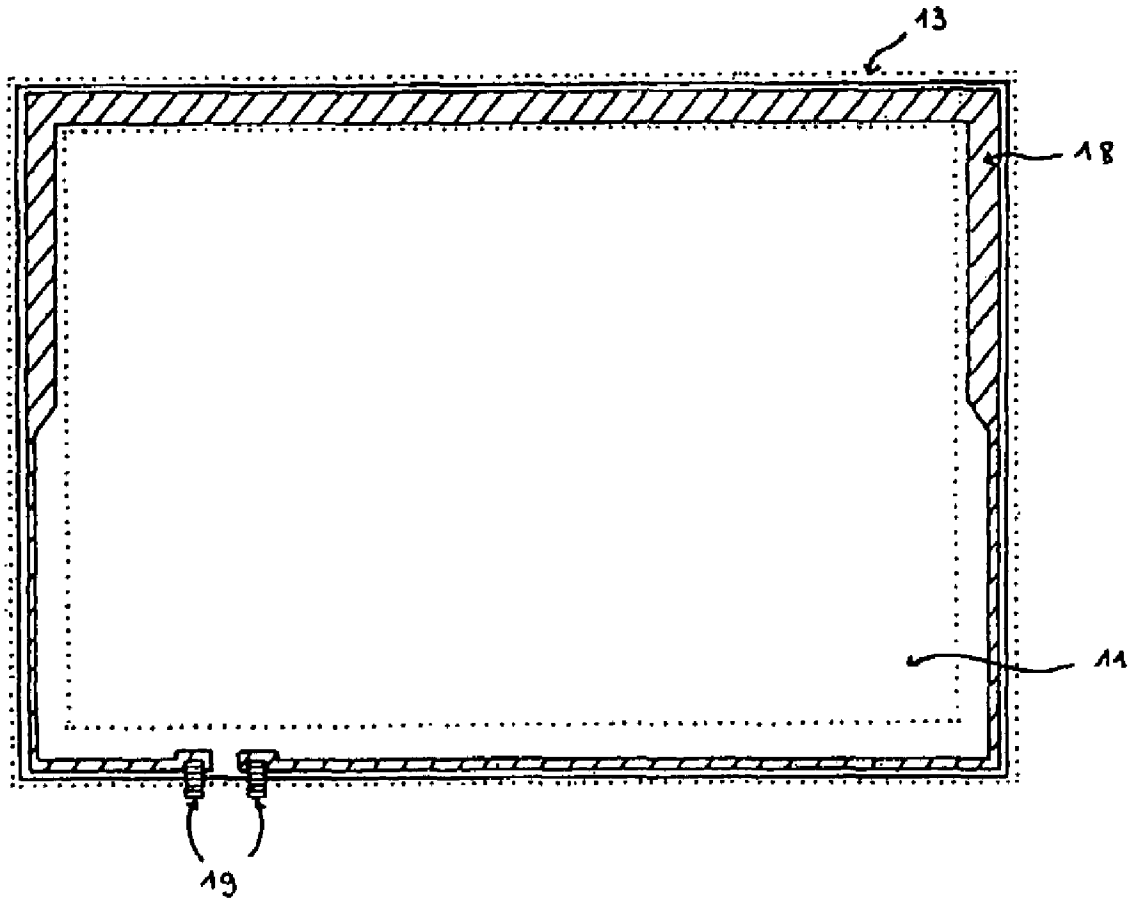
FIG. 2 is a front view of a glazed element according to the first embodiment of the invention.

FIG. 2 shows a front view of a glazed element according to the first embodiment of the invention.

Figure 3:
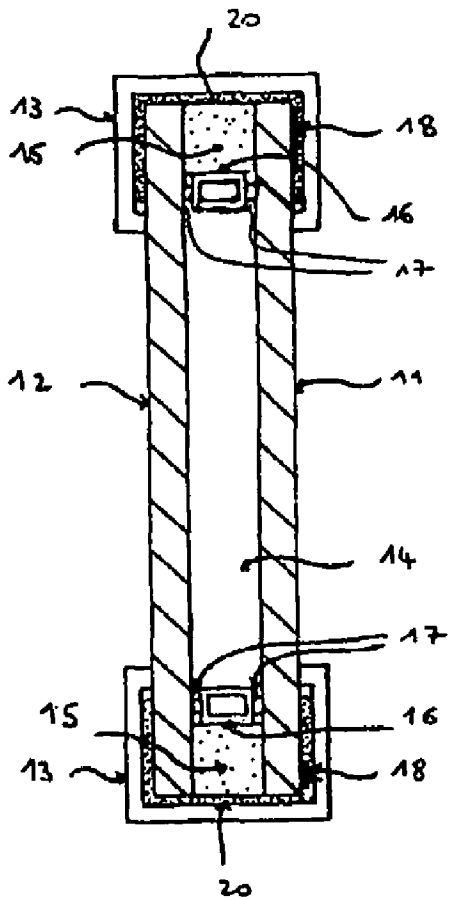
FIG. 3 is a vertical section through the glazed element of FIG. 2.

FIG. 3 is a vertical section through this same element.

According to this embodiment, the glazed element comprises two glass sheets 11, 12, provided with a heating border 18, supported by a frame having the shape of the section 13. In FIG. 2, the section 13 is represented by dotted lines in order to show the heating border 18 more clearly.

The glass sheets 11, 12 are separated from each other by a space 14 and joined at the periphery by a seal 15, which is watertight. Into the space 14, at a small distance from the edge of the sheets 11, 12, is inserted a hollow section 16 containing a desiccating agent, which is fixed to the glass by an adhesive bead 17. The outer sheet 11 is provided, on its external face, with a heating border 18 of variable width which extends over the four sides of the sheet, the ends of which bear a terminal 19 for the electrical supply. A heat-conducting seal 20 provides the connection between the border 18 and section 13.

Figure 5:
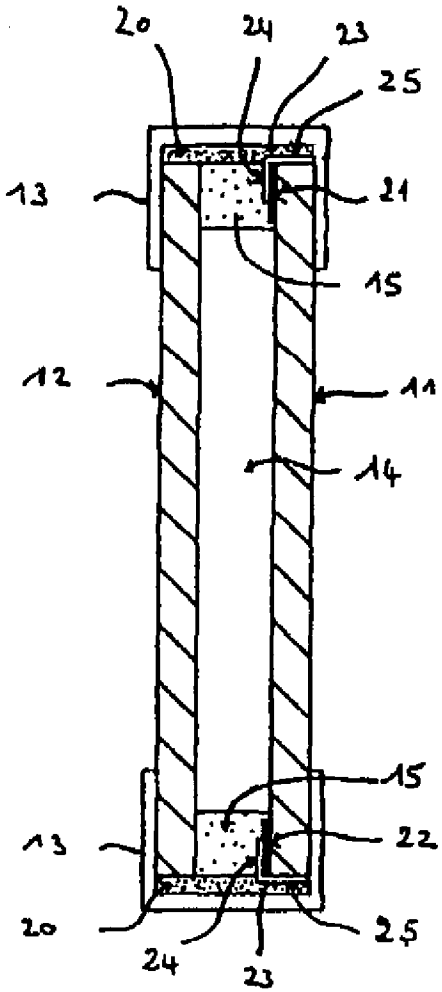
FIG. 5 is a vertical section through the glazed element of FIG. 4.
Figure 4:
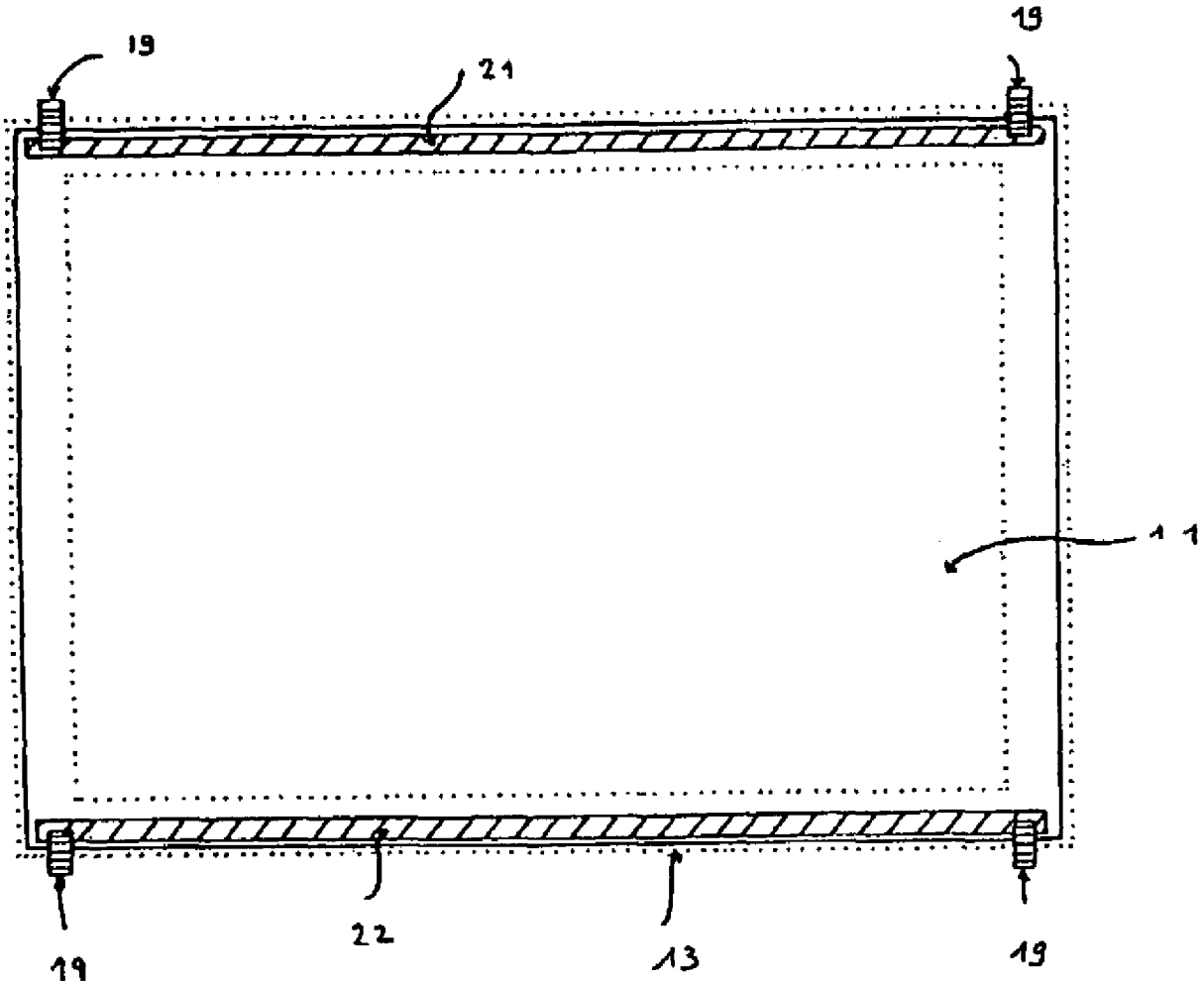
FIG. 4 is a front view of a glazed element according to the second embodiment of the invention.

FIG. 4 shows a front view of a glazed element according to the second embodiment of the invention and FIG. 5 is a vertical cross section through this element.

As above, the element consists of glass sheets 11, 12 supported by the section 13, also shown in dotted lines in FIG. 4. The glass sheets 11, 12, separated by the space 14, are joined at the periphery by the seal 15. The space 14 comprises the hollow section 16 containing the desiccating agent and the adhesive bead 17 (not shown). In this case, the outer sheet 11 bears, on the internal face, two different heating borders 21, 22, of the same width and of a length substantially equal to the sides of the sheet 11, the ends of which bear terminals 19. Intermediate elements 23 are attached to the borders 21, 22 by adhesive bonding or by welding at the end 24, the end remaining free 25 itself being folded toward the sheet 11 and lying in a plane substantially parallel to the thickness of the sheet. The entire surface of the end 25 is thus exposed to contact with the seal 20 in order to heat the section 13.

Figure 7:
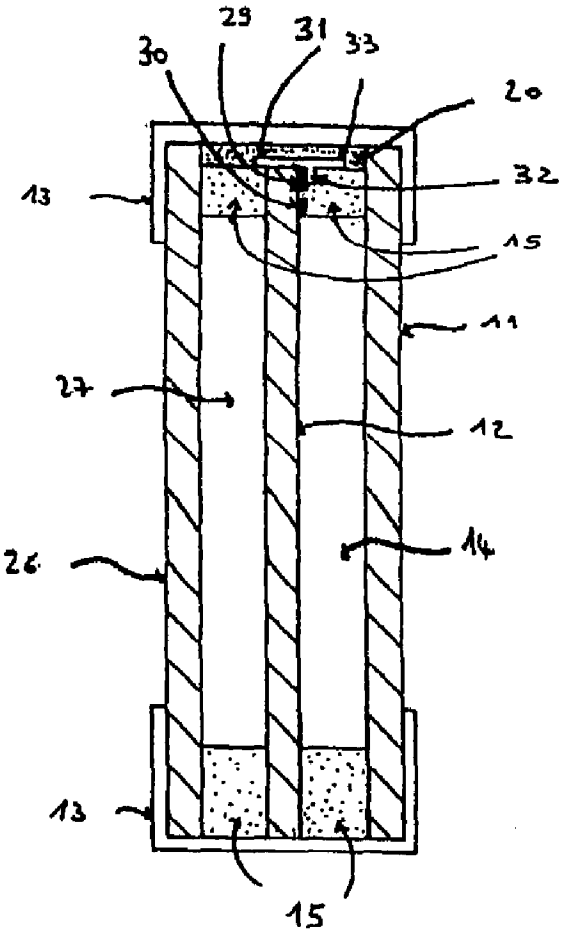
FIG. 7 is a vertical section through the glazed element of FIG. 6.
Figure 6:
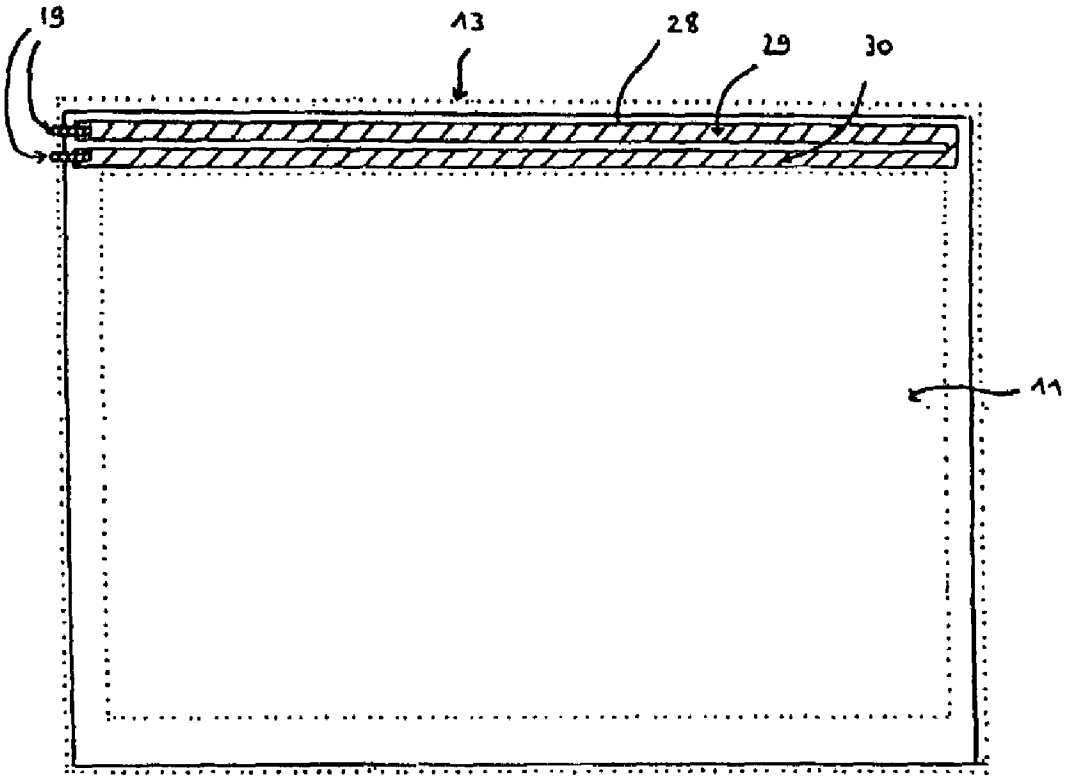
FIG. 6 is a front view of a glazed element according to the third embodiment of the invention.

FIG. 6 shows a front view of a glazed element according to the third embodiment of the invention and FIG. 7 is a vertical section through this element.

In this case, the elements consist of three sheets of glass 11, 12, 26 supported by the section 13, also shown in dotted lines in FIG. 6. The glass sheets 11, 12, 26, separated by the spaces 14, 27, are joined at the periphery by the seal 15. Each space 14, 27 contains the hollow section 16 containing the desiccating agent and the adhesive bead 17 (not shown). In this case, the intermediate sheet 12 bears, on the external face, a heating border 28, formed from upper 29 and lower 30 strips connected together at one side, whose ends provided with terminals 19 are located on the side of the sheet away from the previous side.

In this case, the intermediate element 31 is a T-section, whose web 32 is fastened to the strip 29 of the heating border 28 and whose flanges 33 lie in a plane substantially perpendicular to the plane of the sheet 26 bearing the border. The flanges 33 are joined to the section 13 by means of the conducting seal 20.

The invention claimed is:

1. An insulating glazed element comprising:

at least two glass sheets, separated from each other by a space and joined at a periphery thereof by a seal, and at least one frame section, wherein said element has at least one heating border on at least one face of at least one of the glass sheets, said heating border being connected at opposite ends thereof to an electrical supply terminal for being heated, and wherein said border is covered by the at least one frame section and is joined to the at least one frame section by a heat-conducting seal.

2. The element as claimed in claim 1, wherein the heating border includes an enamel or a resin containing metal particles.

3. The element as claimed in claim 2, wherein the metal particles are chosen from particles of silver, nickel, zinc, copper, graphite, or precious metals such as gold, platinum or palladium.

4. The element as claimed in claim 1, wherein the heating border is borne by an external face of an outer glass sheet of the glass sheets and enclose an end portion of said at least one of said glass sheets.

5. The element as claimed in claims 1, wherein the border is borne by an internal face of an outer glass sheet of the glass sheets.

6. The element as claimed in claim 1, wherein the border is borne by an external face of an intermediate or inner of the glass sheets.

7. The element as claimed in claim 1, wherein the at least two glass sheets comprises at least three glass sheets and said heat conducting element contacts an intermediate glass sheet of said at least three glass sheets.

8. The element as claimed in claim 1, wherein an outer sheet of the glass sheets comprises a glass sheet having undergone thermal toughening.

9. A refrigerated enclosure comprising at least one glazed element according to claim 1.

10. An insulating glazed element comprising:

at least two glass sheets, separated from each other by a space and joined at a periphery thereof by a seal, and at least one-frame-section, wherein said element has at least one heating border on at least one face of at least one of the glass sheets, and wherein said border is covered by the at least one-frame-section and is joined to the at least one-frame-section by a heat-conducting seal; and an intermediate heat-conducting element combined with the heating border, configured to increase a contact area between the border and the heat-conducting seal.

* * * * *